United States Patent [19]

Wilfert et al.

[11] 4,274,598

[45] Jun. 23, 1981

[54] ELECTROMAGNETIC FUEL INJECTION VALVE FOR INTERNAL COMBUSTION ENGINES

[75] Inventors: Thomas Wilfert, Markgfönigen; Rudolf Babitzka, Kirchberg; Walter Schlagmüller, Schwiebergingen, all of Fed. Rep. of Germany

[73] Assignee: Robert Bosch GmbH, Stuttgart, Fed. Rep. of Germany

[21] Appl. No.: 12,535

[22] Filed: Feb. 15, 1979

[30] Foreign Application Priority Data

Feb. 18, 1978 [DE] Fed. Rep. of Germany ..... 2807052

[51] Int. Cl.[3] ..... B05B 1/30

[52] U.S. Cl. ..... 239/585

[58] Field of Search ..... 239/488, 489, 585, 124, 239/533.11–533.15

[56] References Cited

U.S. PATENT DOCUMENTS

| | | | |
|---|---|---|---|
| 2,812,979 | 11/1957 | Ziesche et al. | 239/488 X |
| 3,241,768 | 3/1966 | Croft | 239/585 X |
| 4,007,880 | 2/1977 | Hans et al. | 239/585 |

FOREIGN PATENT DOCUMENTS

| | | | |
|---|---|---|---|
| 2034078 | 1/1972 | Fed. Rep. of Germany | 239/585 |

*Primary Examiner*—James B. Marbert
*Assistant Examiner*—Gene A. Church
*Attorney, Agent, or Firm*—Edwin E. Greigg

[57] ABSTRACT

An injection valve which serves to inject fuel into the intake manifold of a vehicle engine. The valve has a spin chamber upstream of the injection port which can be connected with a return line to the supply pump providing the pressure, for the purpose of continuous maintenance of a spinning motion of the fuel. The closing body of the valve has a projection extending into the injection port and beyond the valve seat which prevents drip formation when the valve opens.

1 Claim, 5 Drawing Figures

ELECTROMAGNETIC FUEL INJECTION VALVE FOR INTERNAL COMBUSTION ENGINES

BACKGROUND OF THE INVENTION

The invention relates to an electromagnetic fuel injection valve for internal combustion engines which includes a spin chamber located immediately upstream of the valve seat into which chamber the fuel enters via at least one inflow bore, all of which will be understood as the description progresses. These fuel injection valves are intended particularly for low-pressure fuel injection systems, in which the fuel is injected behind the throttle valve into the intake line of the internal combustion engine. In these systems, good fuel preparation is required so that the atomized fuel is carried along with the induced air and delivered in equal amounts to the branch tubes of the intake manifold which induce the mixture one after another. The maintenance of a continuous spinning motion of the fuel in the spin chamber located behind the injection port has the effect that even at the beginning of each opening valve stroke, there is spin energy available for a fine atomization of the fuel, which is of great advantage particularly in systems which have especially short injection pulses.

In known valves of the type referred to above, the closing body which monitors the injection port is conventionally embodied as a needle with a conical or frusto-conical tip. In this embodiment of the closing body, despite the spin constantly maintained in the spin chamber, it can happen that during the formation phase of an injection jet the spin does not transform pulses in the form of a spray jet, but rather that the jet leaves the injection opening in the form of a cord-like stream at first and thus tends to drip. Especially in systems operating in rapid cycles, this can mean that the ejected fuel is not atomized in the induced air stream in the manner desired and to the extend required for peak performance of the internal combustion engine.

OBJECT AND SUMMARY OF THE INVENTION

The fuel injection valve according to the invention has the distinct advantage over the prior art disclosures that the stream of spray undergoes sufficiently fine distribution early in the formation phase, by which means the injection quality as a whole is improved.

By means of the features disclosed in the dependent claims, advantageous further embodiments and improvements of the subject disclosed in the main claim 1 are possible. The apportionment of the fuel can be suitably accomplished by means of at least one throttle point in the line leading to the spin chamber in the interior of the valve, which renders the valve resistant to fouling. The throttle point can be advantageously embodied as a bore which leads from an annular chamber in the valve housing which surrounds the spin chamber at least approximately tangentially into the spin chamber.

The spray operation can be further improved if an auxiliary valve is provided in the return flow bore of the spin chamber, the closing body of which is functionally coupled with the closing body which monitors the injection port and closes the return flow bore whenever the closing body opens the injection port, and vice versa.

The invention will be better understood as well as further objects and advantages thereof become more apparent from the ensuing detailed description of two preferred embodiments taken in conjunction with the drawings.

DESCRIPTION OF THE PREFERRED EMBODIMENTS

Figure 1:
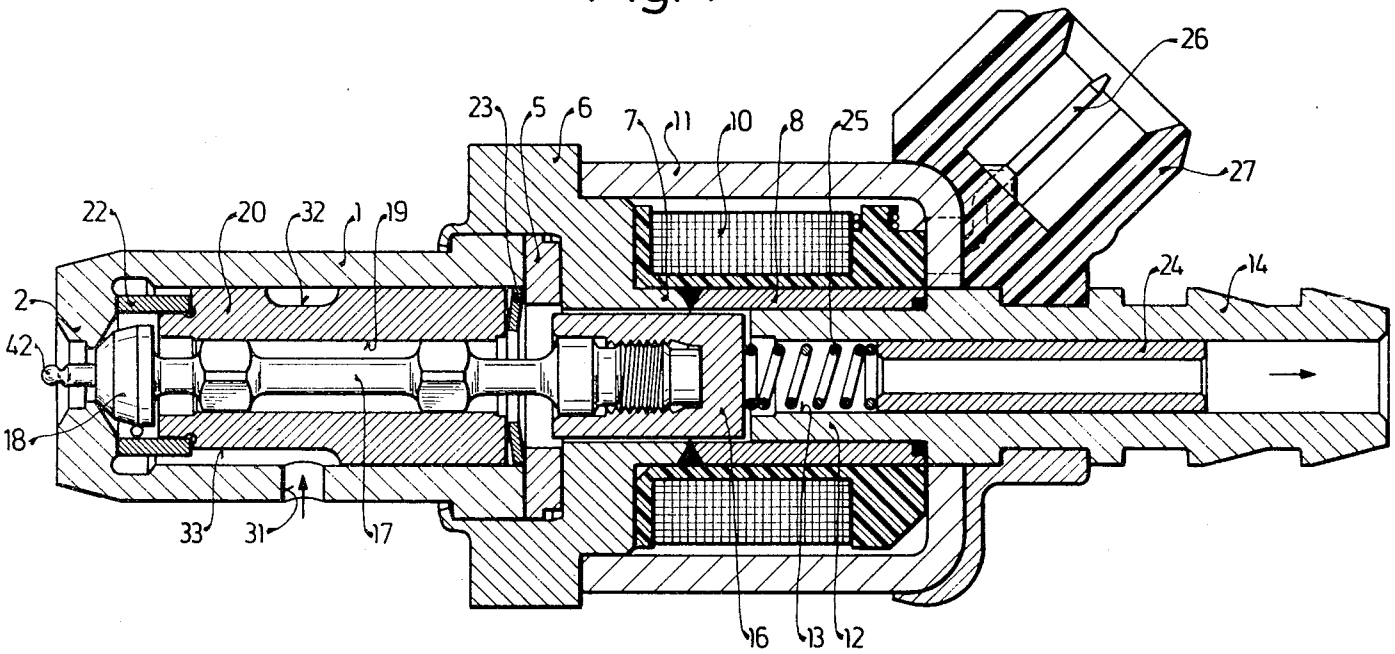
FIG. 1 is a longitudinal cross-sectional view of the first embodiment of the invention.
Figure 2:
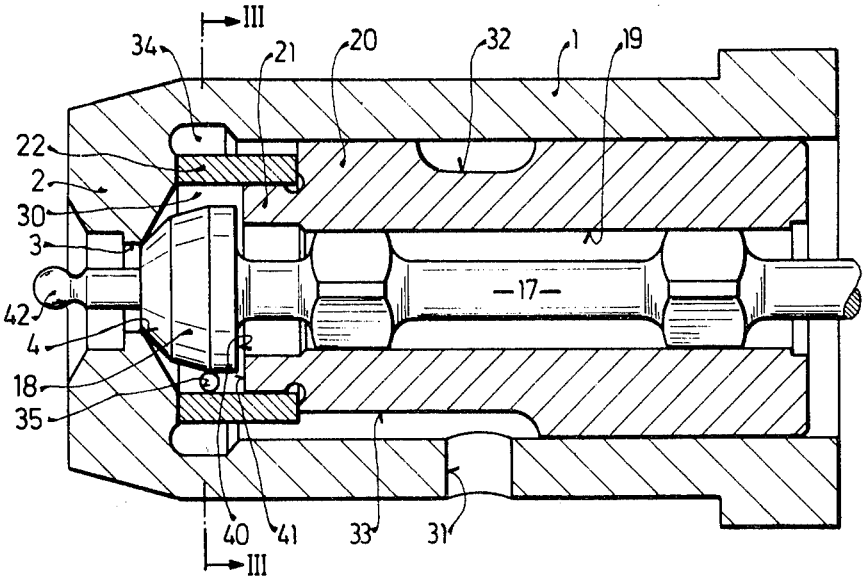
FIG. 2 shows a detailed cross-sectional view of the valve of FIG. 1 on a larger scale.
Figure 3:
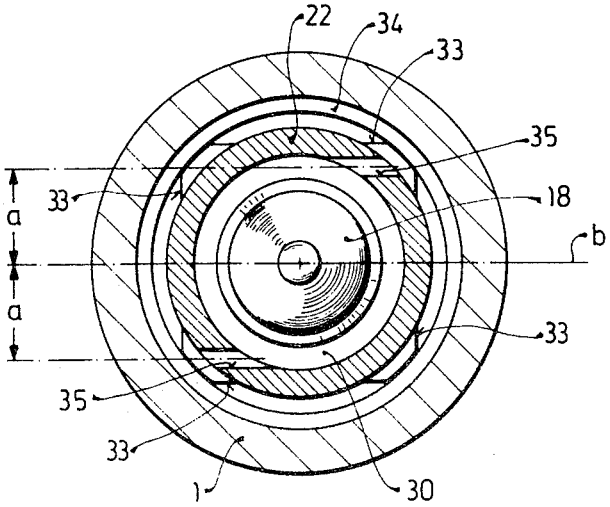
FIG. 3 is a section along the line III—III of FIG. 2.

Turning now to the drawings, the valve shown in FIGS. 1–3 has a cup-shaped housing 1 having an end wall 2, in which there is provided an injection port 3 and in close proximity thereto a valve seat 4. The housing 1, with an interposed disc 5, is securely fastened to a flange element 6, which is provided with an annular projection 7 and to which a casing 8 of non-magnetizable material is welded, as shown. A magnetic coil 10 is arranged to be positioned on the casing 8 and the annular projection 7 and is then entirely encompassed by a centrally apertured bell-shaped jacket member 11. A soft-iron core 12 projects through the aperture in the jacket 11 into the casing 8 and further includes a central bore 13. The core 12 has an extension which forms an attachment tube 14 for a fuel line. The jacket 11 forms a magnetic return path between the flange 6 and the soft-iron core 12.

An armature 16 which is guided with a certain degree of freedom in the casing 8 and the flange 6 is supported opposite the soft-iron core 12. A valve needle 17 includes a stub area that is threadedly connected to the armature 16 and at its opposite end has a head 18 which acts as the closing body for the injection port 3. The valve needle 17 includes means by which it is guided within the bore 19 of a bushing 20 with the bushing being inserted into the valve housing 1. The bushing 20 has a collar 21 onto which an annular body 22, which has an outer diameter smaller than the inner diameter of the housing 1, is pressed. The annular body 22 is abutted against the interior end wall 2 by a Belleville spring member 23 (see FIG. 1) that is arranged so as to have one wall engage the disc 5 while its other wall abuts the bushing 20. Thus, the annular body 22 and the bushing 20 are held firmly within the housing 1 and free of any play. A spring element 25 is interposed between the armature 16 and a bushing 24 that is fitted into the attachment tube 14, and this tends to press the valve needle 17 against the valve seat 4 on the injection port 3. The magnetic coil 10 has an attachment contact 26, which is surrounded by a synthetic bushing element 27, which is anchored onto the jacket 11 as well as onto the attachment tube 14.

The valve has a so-called spin chamber 30 (see FIG. 3) at the injection port 3, in which chamber the fuel is in constant spinning motion—even when the valve is closed. For this purpose, the valve is provided with two fuel attachments, of which one is to be connected with the high-pressure side of the fuel supply pump and the other with the low-pressure side of the pump. The valve thus has a constant flow of fuel through it, so that at the beginning of an opening stroke the spin necessary for a good preparation of the fuel to be supplied is already available.

The feeding of the fuel to the spin chamber 30 takes place via a radial bore 31 in the housing 1, which bore, in the valve as installed, is covered by an annular sleeve (not shown) provided with a feed line and tightly secured to the housing. An annular groove 32 in the bushing 20 is disposed opposite the radial bore 31 and is connected via several equi-distantly disposed flattened areas 33 (see FIG. 3) on the circumference of the bushing 20 with an annular chamber 34 being disposed between the housing 1 and the annular body 22. The annular chamber 34 communicates via two bores 35 in the annular body 22 with the spin chamber 30. The bores 35 are embodied as apportionment bores of precisely calibrated diameter, disposed parallel to one another and each displaced by an amount a from a longitudinal plane b of the valve (see FIG. 3). From the spin chamber 30 the fuel proceeds, when the injection port is closed, into the bore 19 within which the valve needle 17 is guided. The bore 19 is connected with the bore 13 in the attachment nozzle 14 by means of the play between the armature 16 and its guide. In the present case, the attachment nozzle 14 leads to a return flow line to the supply pump.

The valve is provided with an auxiliary valve within the return flow line which extends from the spin chamber 30 to the supply pump. This auxiliary valve closes the return flow line when the injection port 3 is opened, and vice versa. The auxiliary valve is formed directly at the outlet of the spin chamber 30, thus in this way the head 18 of the valve needle 17 acts simultaneously as the closing body for the valve at the injection port 3 and as the closing body of the auxiliary valve. To this end, the head 18 is provided on its side remote from the injection port 3 with an annular shoulder 40, which cooperates with the rim 41 of the bore 19 in the bushing 20 to serve as the valve seat and as the means for limiting the opening stroke of the valve needle 17.

The head 18 of the valve needle 17 is provided in accordance with the invention with a projection 42, which extends through the injection port 3 and outwardly beyond the end of the housing 1, all of which is clear from the drawings. The diameter of the projection 42 is adapted with respect to the diameter of the injection port 3 in such a way that the fuel undergoes no further throttling in the injection port and the apportionment function of the calibrated bores 35 is not restricted.

When the valve is closed, the fuel in the spin chamber 30 is kept in constant spinning motion so that the fuel delivered in the bore 31 is fed to the rear again via the attachment tube 14. When the valve needle 17 is retracted, the return flow of fuel in interrupted by closing the bore 19, so that the total spine energy is expended to the benefit of the fuel being atomized and expelled through the injection port 3. Even in the formation phase of each stream of spray, due to the disposition of the projection 42, a fine distribution of the fuel is attained. The apportionment is not changed, because it still takes place through the apportionment bores 35. The described valve is also resistant to fouling, because the apportionment cross sections are in the interior of the valve.

Figure 4:
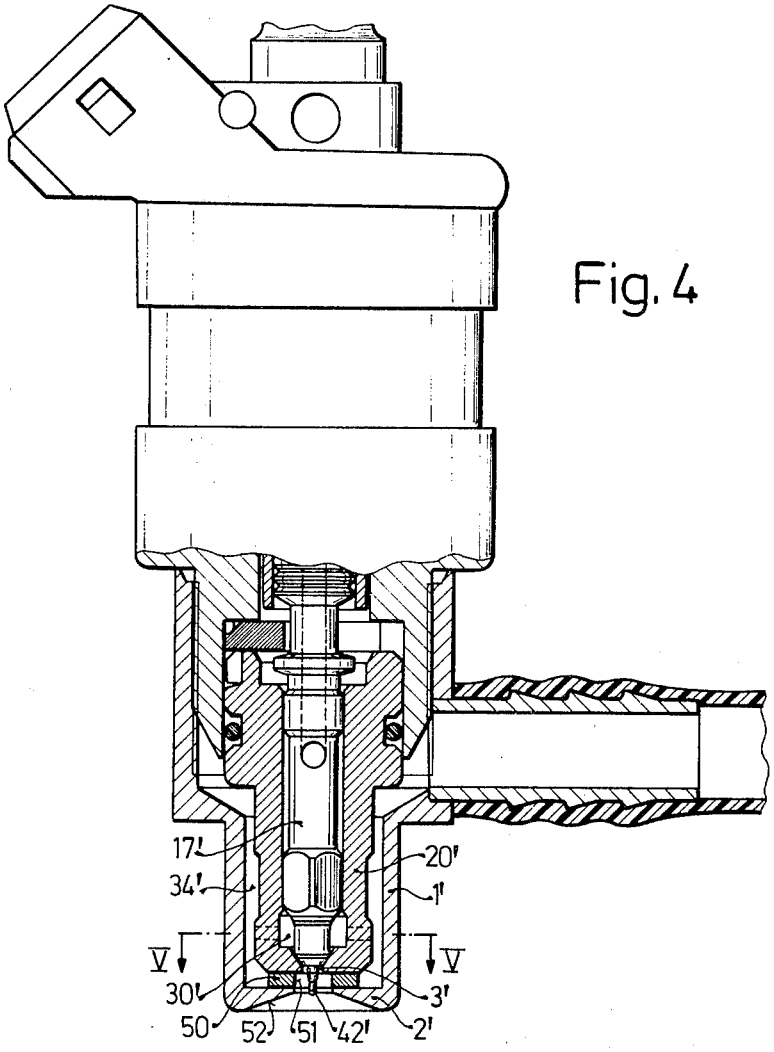
FIG. 4 shows the second embodiment of the invention partly in elevation and partly in cross section.
Figure 5:
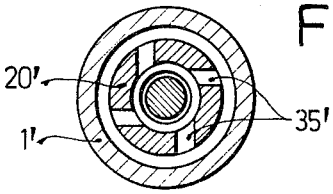
FIG. 5 is a section along the line V—V of FIG. 4.

In the second embodiment of the invention the valve shown in FIGS. 4 and 5 has no auxiliary valve in the fuel return line, and the annular chamber 34' is connected with the spin chamber 30' via four bores 35' which discharge tangentially thereinto and the diameter of the bores is large enough that they do not perform any apportionment function. The apportionment of fuel in this case is determined solely by the opening duration of the valve and by the pre-pressure and the return-flow pressure. The bushing 20', which guides the valve needle 17', has its front face arranged to rest on a plate 50, and this design thus forms a section 51 of wider diameter in the injection port, into which the projection 42' of the valve needle 17' is adapted to extend. The plate 50 in turn is supported on the end wall 2' of the valve housing 1'. It is also to be observed that the plate 50 has an aperture which is complemental to the central aperture in the housing 1 and that the end wall 2' has a tapered conical portion that diverges outwardly toward the annular exterior wall of the housing 1'.

Moreover, in the second embodiment according to FIGS. 4 and 5 as well, the projection 42' on the valve needle 17' assures that during the formation of each stream of spray, the formation of drips is entirely eliminated. This occurs because the fuel leaving the spin chamber 30' when the valve opens impacts against the projection 42' and is thereby at least coarsely atomized. When the valve is fully opened, the spin energy in the spin chamber 30' is fully transferred into the existing stream of spray, by which means the desired shape of the stream of spray and a problem-free injection quality is attained.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. An electromagnetic fuel injection valve for internal combustion engines, in particular vehicle engines with intake manifold injection comprising a housing having a valve seat and an injection port downstream of said valve seat, a spin chamber located immediately upstream of said valve seat into which chamber the fuel enters in a swirl path via at least one inflow bore, an annular body defining an annular chamber encompassing said spin chamber, a plurality of bores in said annular body for introducing fuel tangentially and upstream into said spin chamber, each of said plurality of bores having a calibrated diameter to provide a throttle point for metering the introduction of fuel into said spin chamber, said spin chamber having a return flow bore for fuel flow therethrough with the return flow bore connected with a return line to a pressure-generating supply pump, said valve including a closing body having a projection extending into said injection port and extending outwardly beyond the housing, said projection having a diameter of a dimension that the fuel undergoes no further throttling in the injection port and the apportionment function of the calibrated bores is not restricted, said closing body also including an auxiliary valve in said return flow bore which extends from said spin chamber to said pressure-generating supply pump, said auxiliary valve arranged to monitor said injection port and close said return flow bore when the valve needle of said closing body opens said injection port, and vice versa.

* * * * *

UNITED STATES PATENT AND TRADEMARK OFFICE

CERTIFICATE OF CORRECTION

PATENT NO. : 4,274,598

DATED : June 23, 1981

INVENTOR(S) : Thomas Wilfert et al

It is certified that error appears in the above—identified patent and that said Letters Patent is hereby corrected as shown below:

On The Title Page

[75] line 1, correct the spelling from "Markgfönigen" to -- Markgröningen --,

[75] line 3, correct the spelling from "Schwiebergingen" to -- Schwieberdingen --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*